US008933980B2

(12) United States Patent
Park

(10) Patent No.: US 8,933,980 B2
(45) Date of Patent: Jan. 13, 2015

(54) LIGHT SCANNING UNIT AND IMAGE FORMING APPARATUS INCLUDING THE SAME

(71) Applicant: Samsung Electronics Co., Ltd., Suwon-si, Gyeonggi-do (KR)

(72) Inventor: Chul-hyun Park, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 13/963,374

(22) Filed: Aug. 9, 2013

(65) Prior Publication Data

US 2014/0225974 A1 Aug. 14, 2014

(30) Foreign Application Priority Data

Feb. 12, 2013 (KR) ..... 10-2013-0014970

(51) Int. Cl.
*B41J 15/14* (2006.01)
*B41J 27/00* (2006.01)
*G03G 15/04* (2006.01)

(52) U.S. Cl.
CPC ..... *G03G 15/04036* (2013.01)
USPC ..... 347/242; 347/257

(58) Field of Classification Search
USPC ..... 347/230, 241–245, 256–261, 263
See application file for complete search history.

(56) References Cited

U.S. PATENT DOCUMENTS

| | | | | |
|---|---|---|---|---|
| 7,782,353 | B2 | 8/2010 | Kato et al. | |
| 8,107,148 | B2 * | 1/2012 | Narita et al. | 359/207.11 |
| 8,189,251 | B2 * | 5/2012 | Narita | 359/205.1 |
| 8,199,180 | B2 * | 6/2012 | Nakaie et al. | 347/241 |
| 2005/0024481 | A1 * | 2/2005 | Takayama | 347/243 |
| 2010/0189451 | A1 * | 7/2010 | Murayama | 399/47 |

* cited by examiner

*Primary Examiner* — Hai C Pham
(74) *Attorney, Agent, or Firm* — Staas & Halsey LLP

(57) ABSTRACT

A light scanning unit and an electrophotographic image forming apparatus are provided. The light scanning unit includes a light source unit for emitting a light beam, a light deflector for scanning and deflecting the light beam, an imaging optical system having an imaging lens for imaging the scanned and deflected light beam, and first and second reflection members arranged on an optical path, a housing, and first and second assembly members for pressing and fixing the first and second reflection members on the housing. The assembly members press and fix the reflection members on the housing by pressing the reflection members in a direction in which curvature of a scanning line due to the inclination of the first reflection member and curvature of a scanning line due to the inclination of the second reflection member are offset with each other.

21 Claims, 12 Drawing Sheets

LIGHT SCANNING UNIT AND IMAGE FORMING APPARATUS INCLUDING THE SAME

CROSS-REFERENCE TO RELATED APPLICATIONS

This application is related to, and claims priority to, Korean Patent Application No. 10-2013-0014970, filed on Feb. 12, 2013, in the Korean Intellectual Property Office, the disclosure of which is incorporated herein in its entirety by reference.

BACKGROUND

1. Field

Exemplary embodiments of the present invention relate to a light scanning unit and an image forming apparatus including the light scanning unit, and more particularly, to a light scanning unit having an improved installation structure of a reflection member, and an image forming apparatus including the light scanning unit.

2. Description of the Related Art

An electrophotographic image forming apparatus such as a laser printer, a digital copier, a multifunctional printer (MFP), etc. has a structure in which a light beam may be scanned onto an image holding body through a light scanning unit so as to form an electrostatic latent image. The electrostatic latent image is developed into a developed image by using a developer such as toner, and the developed image is transferred to a print medium.

To produce a color image in the image forming apparatus, a light beam may be scanned onto each of image holding bodies corresponding to different colors. An electrostatic latent image formed on each image holding body is developed by using toner of different colors, and developed images of different colors are transferred to a single print medium. The light scanning unit can be made compact by an oblique incidence method using a single optical deflector. According to an oblique incidence type light scanning unit, to guide a light beam that has been scanned by an optical deflector toward each image holding body corresponding to an individual color, a plurality of light beams are obliquely incident upon a deflection surface that is perpendicular to a rotational axis of an optical deflector, and then a luminous flux is split.

The oblique incidence type light scanning unit has an advantageous structure in reducing material costs due to a compact optical path layout and a reduced number of parts. In order to have light beams scanned at appropriate positions in the light scanning unit, a reflection mirror may be arranged on an optical path of each light beam. In the light scanning unit, when an imaging lens is arranged at a position close to a to-be-scanned surface of an image holding body and the reflection mirror is arranged between the optical deflector and the imaging lens, a placement angle causes a change of the position of a light beam scanned onto the imaging lens, sensitively affecting the curvature of a scanning line. In an attempt to address the above issue, in a conventional light scanning unit, an adjustment member for correcting the curvature of a scanning line may be provided on a reflection mirror holder. Thus, when a reflection mirror is coupled to a housing of a light scanning unit, the reflection mirror is fixed after a placement angle of the reflection mirror is adjusted by using the adjustment member.

However, conventional light scanning units have problems in that material costs are increased as a separate adjustment member may be added to adjust the placement angle of a reflection mirror, and productivity is degraded as an adjustment process is added for mass production. In addition, in a conventional light scanning unit, a pressure direction of the adjustment member for adjusting the placement angle of a reflection mirror of a holder for fixing the reflection mirror may be designed to change a scanning line curvature characteristic in the same direction. Accordingly, when a print operation is continuously performed and thus the temperature of an interior of an image forming apparatus increases, a holder that fixes the reflection mirror is thermally deformed and thus a placement surface of the reflection mirror collapses to incline. As a result, the scanning line curvature characteristic is adversely affected.

SUMMARY

Additional aspects and/or advantages will be set forth in part in the description which follows and, in part, will be apparent from the description, or may be learned by practice of the invention.

According to an exemplary embodiment of the present invention, a light scanning unit is provided that may reduce a change in a scanning curvature characteristic due to the inclination of a reflection member in an oblique incidence type light scanning unit and may obtain a high quality color image without using an adjustment member, and an image forming apparatus including the light scanning unit.

According to an aspect of the present invention, a light scanning unit includes a light source unit for emitting a light beam according to an image signal, a light deflector for scanning and deflecting the light beam emitted from the light source unit, an imaging optical system that includes at least one imaging lens arranged on an optical path from the light deflector to a to-be-scanned surface and imaging the light beam scanned and deflected by the light deflector on the to-be-scanned surface, and first and second reflection members arranged on the optical path from the light deflector to the to-be-scanned surface, a housing for accommodating the light source unit, the light deflector, and the imaging optical system, and first and second assembly members for pressing and fixing the first and second reflection members on the housing, in which the first and second assembly members press and fix the first and second reflection members on the housing by pressing the first and second reflection members in a direction in which curvature of a scanning line due to the inclination of the first reflection member and curvature of a scanning line due to the inclination of the second reflection member are offset with each other.

A reflection surface of the first reflection member and a reflection surface of the second reflection member may be arranged to face each other and, in view of a sub-scanning section, pressing directions of the first and second assembly members are determined such that a direction in which the first reflection member is inclined by the first assembly member and a direction in which the second reflection member is inclined by the second assembly member are substantially the same direction.

The first assembly member may include a first placement portion having a first groove portion into which a part of the first reflection member is inserted and a first pressing member inserted in a gap between the first reflection member and the first groove portion and pressing and fixing the first reflection member, and the second assembly member may include a second placement portion having a second groove portion into which a part of the second reflection member is inserted and a second pressing member inserted in a gap between the second reflection member and the second groove portion and pressing and fixing the second reflection member A reflection surface of the first reflection member and a reflection surface of the second reflection member may be arranged to face each other, and a pressing direction of the first assembly member may be toward the reflection surface of the first reflection member and a pressing direction of the second assembly member may be toward a rear surface of the reflection surface of the second reflection member.

A direction in which a first placement surface of the first placement portion, where the first reflection member is placed, may be deformed due to the first assembly member and a direction in which a second placement surface of the second placement portion, where the second reflection member is placed, may be deformed due to the second assembly member are substantially the same direction in view of a sub-scanning section.

The first and second pressing members may be elastic springs that elastically press the first and second reflection members.

The first and second pressing members may be wedges that are forcibly inserted into the first and second groove portions to press the first and second reflection members.

The first reflection member may be arranged on an optical path between the at least one imaging lens and the light deflector and the second reflection member may be arranged on an optical path between the at least one imaging lens and the to-be-scanned surface.

The imaging optical system may include a plurality of imaging lenses arranged on the optical path from the light deflector to the to-be-scanned surface, the first reflection member may be arranged on an optical path between the light deflector and an imaging lens located closest to the light deflector, and the second reflection member may be arranged between the plurality of imaging lenses.

The imaging lens located closest to the light deflector among the plurality of imaging lenses may be eccentrically arranged such that a light beam passes through the imaging lens located closest to the light deflector to be deflected in a sub-scanning direction with respect to an apex of an imaging lens located closest to the to-be-scanned surface.

A refractive power of an imaging lens located closest to the to-be-scanned surface in a sub-scanning direction among the plurality of imaging lenses may be substantially zero.

The light source unit may include a plurality of light sources for emitting a plurality of light beams and the first and second reflection members may be provided on an optical path of at least one of the plurality of light beams.

The at least two light beams of the plurality of light beams emitted from the light sources may be scanned by being deflected by the same deflection surface of the light deflector.

At least two light beams may be obliquely incident on deflection surfaces of the light deflector at different incident angles.

The incident angle of the at least two light beams in the sub-scanning section on the deflection surface of the light defector may be within a range between about 2 degrees to about 4 degrees.

The imaging optical system may include one first imaging lens that is located closest to the light deflector and commonly used for the at least two light beams and a plurality of second imaging lenses individually provided with respect to the at least two light beams.

The first reflection member may be arranged on an optical path between the first imaging lens and the second imaging lens and the second reflection member may be arranged on an optical path between the first reflection member and the second imaging lens.

The light source unit may include first to fourth light sources for emitting first to fourth light beams, the light deflector may scan and deflect the first and second light beams of the first to fourth light beams emitted from the first to fourth light sources on a deflection surface of the light deflector and may scan and deflect the third and fourth light beams on another deflection surface that is diagonally located with respect to the light deflector, and the imaging optical system may include one reflection member arranged on an optical path of the first light beam, third and fourth reflection members arranged on an optical path of the third light beam, and another reflection member arranged on an optical path of the fourth light beam, and the first and second reflection members may be arranged on an optical path of the second light beam.

The light scanning unit may further include third and fourth assembly members for respectively pressing and fixing the third and fourth reflection members on the housing, in which, in view of the sub-scanning section, pressing directions of the first to fourth assembly members are determined as a direction, in which the first and second reflection members are inclined by the first and second assembly members, and a direction, in which of the third and fourth reflection members are inclined by the third and fourth assembly members, that are substantially opposite to each other.

According to an aspect of the present invention, an electrophotographic image forming apparatus includes an image holding body, a light scanning unit for forming an electrostatic latent image by scanning a light beam onto a to-be-scanned surface of the image holding body, and a developing unit for developing the electrostatic latent image formed on the image holding body by supplying toner to the electrostatic latent image, wherein the light scanning unit includes a light source unit for emitting a light beam according to an image signal, a light deflector for scanning and deflecting the light beam emitted from the light source unit, an imaging optical system that includes at least one imaging lens arranged on an optical path from the light deflector to the to-be-scanned surface and imaging the light beam scanned and deflected by the light deflector on the to-be-scanned surface, and first and second reflection members arranged on the optical path from the light deflector to the to-be-scanned surface, a housing for accommodating the light source unit, the light deflector, and the imaging optical system, and first and second assembly members for pressing and fixing the first and second reflection members on the housing, in which the first and second assembly members press and fix the first and second reflection members on the housing by pressing the first and second reflection members in a direction in which curvature of a scanning line due to the inclination of the first reflection member and curvature of a scanning line due to the inclination of the second reflection member are offset with each other.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Figure 1:
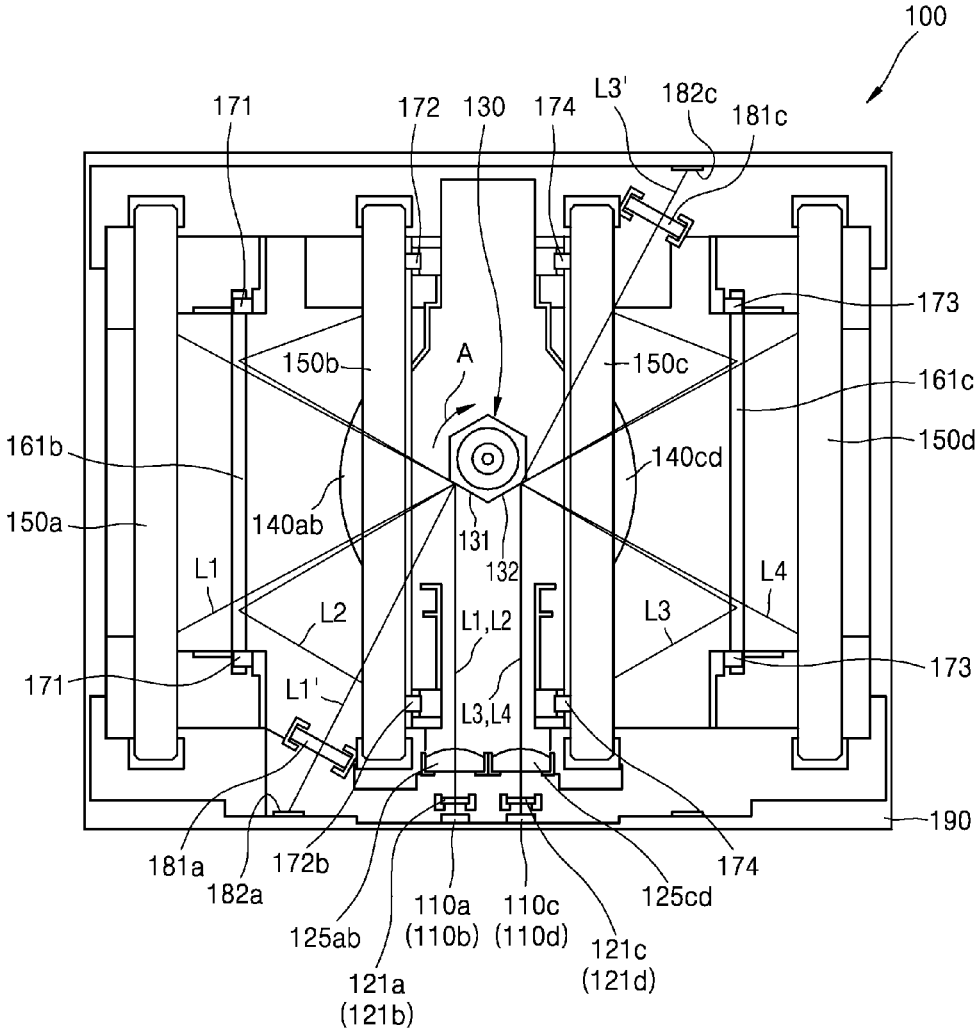
FIG. 1 is a plan view schematically illustrating a light scanning unit according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

The attached drawings for illustrating exemplary embodiments of the present invention are referred to in order to provide understanding of the present invention, the merits thereof, and the objectives accomplished by the implementation of an exemplary embodiment of the present invention. The present invention will be described in detail by explaining exemplary embodiments of the invention with reference to the attached drawings. Like reference numerals in the drawings denote like elements.

As used herein, the term "and/or" includes any and all combinations of one or more of the associated listed items. Expressions such as "at least one of," when preceding a list of elements, modify the entire list of elements and do not modify the individual elements of the list.

Figure 2:
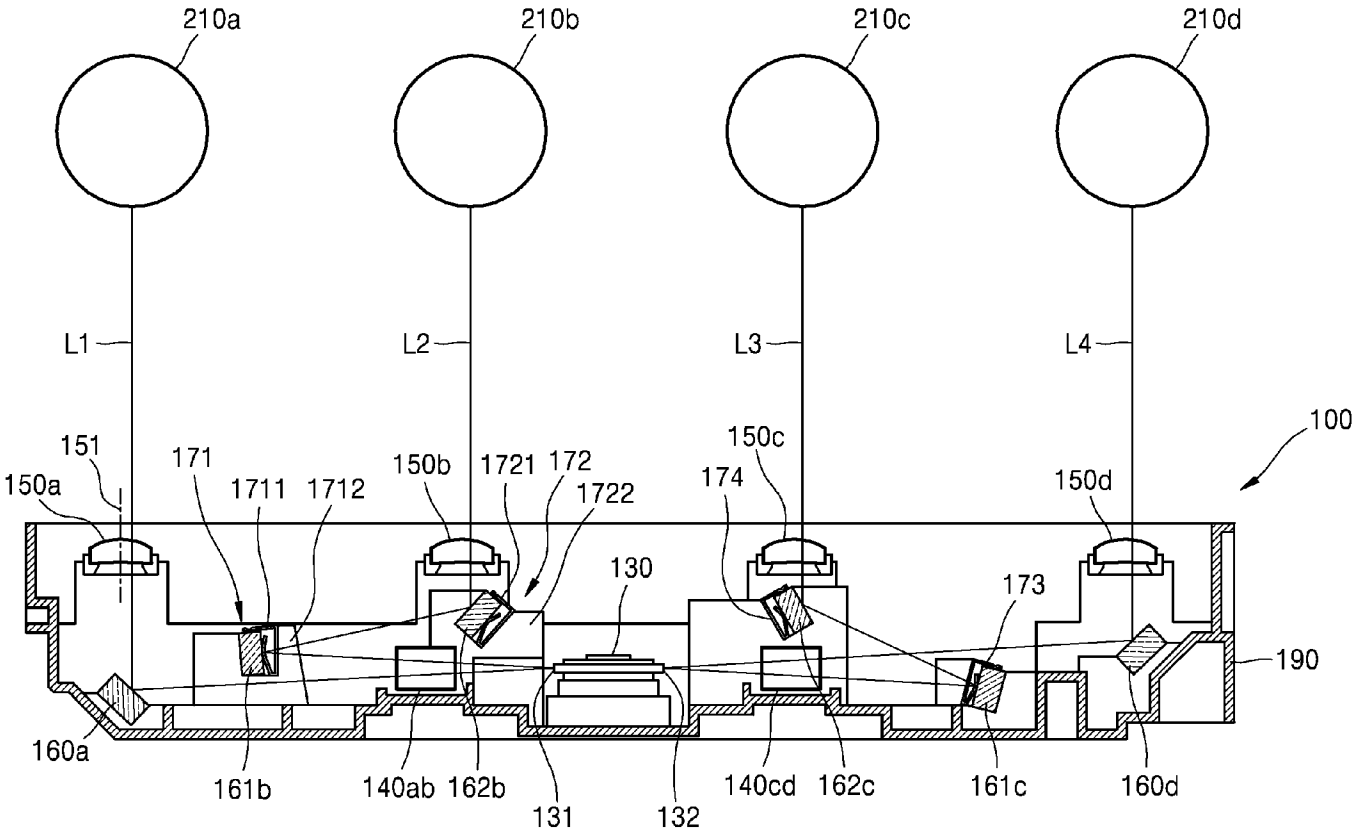
FIG. 2 is a cross-sectional view schematically illustrating an exemplary light scanning unit.
Figure 3:
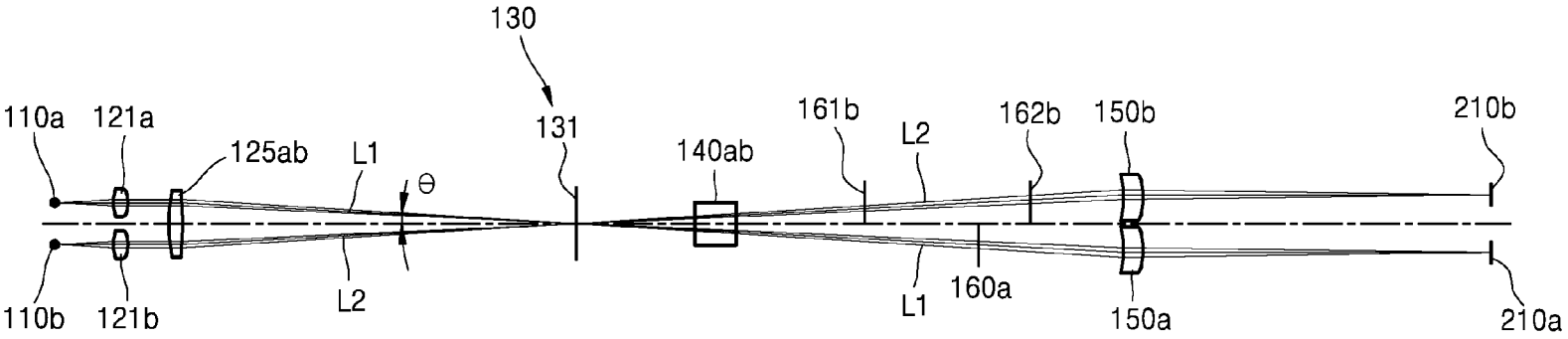
FIG. 3 schematically illustrates an optical configuration of an exemplary light scanning unit.

FIG. 1 illustrates a light scanning unit 100 according to an embodiment of the present invention. FIG. 2 is a cross-sectional view schematically illustrating a light scanning unit 100. FIG. 3 illustrates an optical configuration of a light scanning unit 100, in view of a sub-scanning section. In FIG. 3, folding of an optical path at a deflection surface 131 of a light deflector 130, or at reflection members 160*a*, 161*b*, and 162*b*, is not illustrated to facilitate the graphical representations.

A main scanning section may be defined as a plane upon which each of light beams L1, L2, L3, and L4 is incident when the light beams L1, L2, L3, and L4 are scanned and deflected by rotation A of the light deflector 130. The main scanning section may be parallel to both of a main scanning direction and a direction in which each of the light beams L1, L2, L3, and L4 proceeds, and may also be perpendicular to a rotation axis of the light deflector 130. The main scanning direction signifies a direction in which each of the light beams L1, L2, L3, and L4 is deflected by the rotation of the light deflector 130. A sub-scanning section may be defined as a plane perpendicular to the main scanning direction. The sub-scanning section may be parallel to both a sub-scanning direction and a direction in which each of the light beams L1, L2, L3, and L4 proceeds. The sub-scanning direction may be a normal line to the main scanning plane and also perpendicular to both the main scanning direction B and the direction in which each of the light beams L1, L2, L3, and L4 proceeds. The sub-scanning direction corresponds to a direction in which the to-be-scanned surface is moved by the rotation of each of first to fourth photosensitive drums 210*a*, 210*b*, 210*c*, and 210*d*.

FIG. 1 illustrates an optical arrangement of the light scanning unit 100 of an exemplary embodiment as viewed from a main scanning section. FIGS. 2 and 3 illustrates an optical arrangement of a light scanning unit 100 of an exemplary embodiment viewed from the sub-scanning section.

Referring to FIGS. 1-3, the light scanning unit 100 of an exemplary embodiment includes first to fourth light sources 110*a*, 110*b*, 110*c*, and 110*d* respectively emitting the light beams L1, L2, L3, and L4. Laser diodes may be employed as the first to fourth light sources 110*a*, 110*b*, 110*c*, and 110*d*. The first to fourth light sources 110*a*, 110*b*, 110*c*, and 110*d* may respectively emit the light beams L1, L2, L3, and L4 that are modulated according to image signals corresponding to image information about black K, magenta M, yellow Y, and cyan C colors, for example.

The light beams L1, L2, L3, and L4 respectively emitted from the first to fourth light sources 110*a*, 110*b*, 110*c*, and 110*d* are scanned and deflected by the light deflector 130. The light deflector 130 may be, for example, a multi-facet rotary mirror having a plurality of reflection surfaces, that is, defection surfaces 131 and 132, and rotating around a rotation axis. According to an exemplary embodiment, a light defector 130 may be a microelectromechanical systems (MEMS) mirror.

The first and second light sources 110*a* and 110*b* may be arranged parallel to the sub-scanning direction. The third and fourth light sources 110*a* and 110*d* may be arranged parallel to the sub-scanning direction. When viewed from the main scanning section as illustrated in FIG. 1, the first and second light sources 110*a* and 110*b* may be arranged to overlap with each other and the third and fourth light sources 110*d* and 110*d* may be arranged to overlap with each other. The first and second light sources 110*a* and 110*b* may be symmetrically arranged with respect to the third and fourth light sources 110*d* and 110*d* with the light deflector 130 interposed therebetween.

An incident optical system may be provided on an optical path between the light deflector 130 and each of the first to fourth light sources 110*a*, 110*b*, 110*c*, and 110*d*. The incident optical system may include collimator lenses 121*a*, 121*b*, 121*c*, and 121*d*, which are respectively provided on the optical paths of the first to fourth light beams L1, L2, L3, and L4 and cylindrical lenses 125*ab* and 125*cd*. The collimator lenses 121*a*, 121*b*, 121*c*, and 121*d* are condensing lenses for converting the first to fourth light beams L1, L2, L3, and L4 emitted from the first to fourth light sources 110*a*, 110*b*, 110*c*, and 110*d* into parallel lights or converged lights. The cylindrical lenses 125*ab* and 125*cd* may be anamorphic lenses that focus the first to fourth light beams L1, L2, L3, and L4 in a direction corresponding to the sub-scanning direction so as to have the first to fourth light beams L1, L2, L3, and L4 almost linearly formed on the defection surfaces 131 and 132. As illustrated in FIG. 3, since the first and second light sources 110*a* and 110*b* are arranged close to each other in the sub-scanning direction and the third and fourth light sources 110*c* and 110*d* are arranged close to each other in the sub-scanning direction, one cylindrical lens 125*ab* may be commonly used by the first and second light beams L1 and L2 and another cylindrical lens 125*cd* may be commonly used by the third and fourth light beams L3 and L4. The cylindrical lenses 125*ab* and 125*cd* may be separately provided for each of the first to fourth light beams L1, L2, L3, and L4. The collimator lenses 121*a*, 121*b*, 121*c*, and 121*d* and the cylindrical lenses 125*ab* and 125*cd* may be functionally substituted by a single optical element for each optical path. According to an exemplary embodiment, an aperture stop (not shown) may be provided on the optical path of each of the first to fourth light beams L1, L2, L3, and L4. The aperture stop limits and shapes a section of a luminous flux, that is, a diameter and a shape, of each of the first to fourth light beams L1, L2, L3, and L4.

The incident optical system may be arranged such that the first to fourth light beams L1, L2, L3, and L4 respectively emitted from the first to fourth light sources 110*a*, 110*b*, 110*c*, and 110*d* are obliquely incident on the deflection surfaces 131 and 132 of the light deflector 130. For example, as illustrated in FIG. 3, the first light beam L1 may be obliquely incident on the deflection surface 131 of the light deflector 130 at a predetermined angle θ in an upper side. The second light beam L2 may be obliquely incident on the same deflection surface 131 of the light deflector 130 at a predetermined angle θ in a lower side. The predetermined angles θ of the first and second light beams L1 and L2 may be set, for example, within a range of 2 degrees to 4 degrees. Since the incident optical system may be designed as an oblique optical system, the cylindrical lenses 125*ab* and 125*cd* or first imaging lenses 140*ab* and 140*cd* are commonly used so that the number of parts and material costs are reduced, thereby further facilitating the light scanning unit 100 being compact.

An imaging optical system may be provided on an optical path between the light deflector 130 and each of the first to fourth photosensitive drums 210*a*, 210*b*, 210*c*, and 210*d*. The imaging optical system focuses the first to fourth light beams L1, L2, L3, and L4 that are scanned and deflected by the light deflector 130, respectively on an outer circumferential surface, that is, a to-be-scanned surface, of each of the first to fourth photosensitive drums 210*a*, 210*b*, 210*c*, and 210*d*.

The imaging optical system may include lenses having an fθ characteristic to correct the first to fourth light beams L1, L2, L3, and L4 to be scanned at a uniform velocity on the first to fourth photosensitive drums 210*a*, 210*b*, 210*c*, and 210*d*. The imaging optical system may include the first imaging lenses 140*ab* and 140*cd* and second imaging lenses 150*a*, 150*b*, 150*c*, and 150*d* that are respectively provided on the optical paths of the first to fourth light beams L1, L2, L3, and L4. The first imaging lenses 140*ab* and 140*cd* may be designed to have a refractive power of almost zero in the sub-scanning direction, whereas the second imaging lenses 150*a*, 150*b*, 150*c*, and 150*d* may be designed to have a refractive power needed in the sub-scanning direction. The second imaging lenses 150*a*, 150*b*, 150*c*, and 150*d* located closest to the to-be-scanned surface may be eccentrically arranged such that a light beam may pass by being deflected in the sub-scanning direction with respect to the apex of each lens.

The first imaging lens 140*ab* may be commonly used by the first and second light beams L1 and L2 that are scanned and deflected in the sub-scanning direction while being parallelly separated from each other. The other first imaging lens 140*cd* may be commonly used by the third and fourth light beams L3 and L4 that are scanned and deflected in the sub-scanning direction while being parallelly separated from each other. Since the first imaging lenses 140*ab* and 140*cd* are commonly used, the number of optical elements may be reduced and the light scanning unit 100 may be made compact. Alternatively, the first imaging lenses 140*ab* and 140*cd* may be individually provided for each of the first to fourth light beams L1, L2, L3, and L4. According to an exemplary embodiment the imaging optical system includes two imaging lenses for each optical path, one imaging lens or three or more imaging lenses may be provided for each optical path.

A sync detection optical system for detecting sync signals of the first to fourth light beams L1, L2, L3, and L4 that are scanned and deflected by the light deflector 130 may be provided. For example, the sync detection optical system includes a first sync detection lens 181*a* and a first sync detection sensor 182*a* that are arranged on an optical path of a light beam L1' at a start end of the first light beam L1 that is scanned and deflected by the light deflector 130. A trace of the first light beam L1 that is scanned and deflected according to the rotation of the light deflector 130 forms a single scanning line on the deflection surface 131 of the light deflector 130. As the first sync detection lens 181*a* and the first sync detection sensor 182*a* are arranged at the start end of a scanning line that is scanned and deflected on the deflection surface 131 of the light deflector 130, the first sync detection sensor 182*a* may detect a sync signal indicating the start of a scanning line of the first light beam L1. The sync detection optical system may be arranged at a finish end where main scanning of a scanning line that is scanned and deflected on one deflection surface of the light deflector 130 finishes. A sync detection optical system may detect a sync signal indicating a finish of the scanning line. The sync detection optical system may include a second sync detection lens (not shown) and a second sync detection sensor (not shown) that are arranged on an optical path of the second light beam L2 that is scanned and deflected by the light deflector 130. The sync detection optical system may include a third sync detection lens 181*c* and a third sync detection sensor 182*c* that are arranged on an optical path of a start end L3' of the third light beam L3 that is scanned and deflected by the light deflector 130.

The first to fourth light sources 110*a*, 110*b*, 110*c*, and 110*d*, the incident optical system, the light deflector 130, and the imaging optical system may be mounted in a housing 190. The housing 190 may be formed of a plastic material and may be manufactured by an injection molding method.

The reflection members 160*a*, 161*b*, 162*b*, 161*c*, 162*c*, and 160*d* are provided to allow the first to fourth light beams L1, L2, L3, and L4 scanned by the light scanning unit 100 to proceed in predetermined directions, so as to make the light scanning unit 100 compact. Mirrors or total reflection prisms may be used as the reflection members 160*a*, 161*b*, 162*b*, 161*c*, 162*c*, and 160*d*. The reflection members 160*a*, 161*b*, 162*b*, 161*c*, 162*c*, and 160*d* may be arranged between the lenses of the imaging optical system, or between the imaging optical system and the photosensitive drums 210*a*, 210*b*, 210*c*, and 210*d*, to appropriately change the optical path. As illustrated in FIG. 2, the reflection member 160*a* only is arranged between the first imaging lens 140*ab* and the second imaging lens 150*a* so as to change the optical path once of the first light beam L1 passing through the first imaging lens 140*ab* to proceed toward the first photosensitive drum 210*a*. The reflection members 161*b* and 162*b* are arranged between the first imaging lens 140*ab* and the second imaging lens 150*b* so as to change the optical path twice of the second light beam L2 passing through the first imaging lens 140*ab* to proceed toward the second photosensitive drum 210*b*. The reflection members 161*c* and 162*c* are arranged between the first imaging lens 140*cd* and the second imaging lens 150*c* so as to change the optical path twice of the third light beam L3 passing through the first imaging lens 140*cd* to proceed toward the third photosensitive drum 210*c*. The reflection members 161*b* and 162*b* are referred to as the first and second reflection members 161*b* and 162*b*, respectively, and the reflection members 161*c* and 162*c* are referred to as the third and fourth reflection members 161*b* and 162*b*, respectively. The reflection member 160*d* only may be arranged between the first imaging lens 140*cd* and the second imaging lens 150*d* so as to change the optical path once of the fourth light beam L4 passing through the first imaging lens 140*cd* to proceed toward the fourth photosensitive drum 210*d*.

Figure 14:
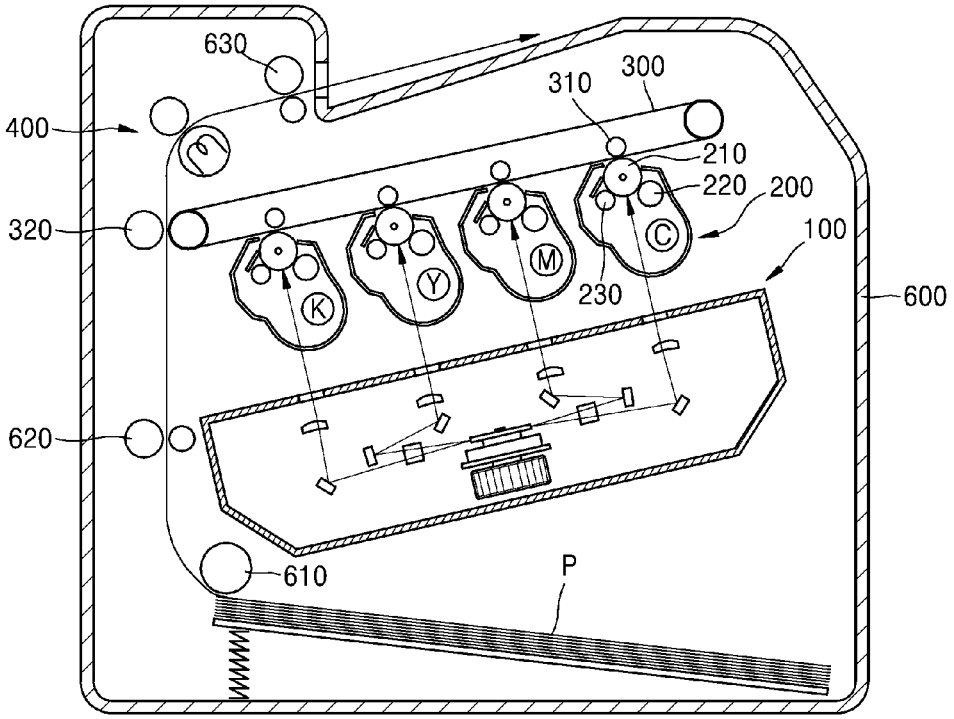
FIG. 14 illustrates an electrophotographic image forming apparatus including the light scanning unit, according to an embodiment of the present invention.

Since the reflection members 160*a*, 161*b*, 162*b*, 161*c*, 162*c*, and 160*d* are arranged such that the first to fourth light beams L1, L2, L3, and L4 can be scanned in the same direction, the light scanning unit 100 according to an exemplary embodiment may be applied to a tandem type image forming apparatus in which the first to fourth photosensitive drums 210*a*, 210*b*, 210*c*, and 210*d* are arranged parallel to each other (see, for example, FIG. 14).

An assembly member for fixing the reflection members 160*a*, 161*b*, 162*b*, 161*c*, 162*c*, and 160*d* may be arranged in consideration of the collapse of the reflection members 160*a*, 161*b*, 162*b*, 161*c*, 162*c*, and 160*d*.

The first and second reflection members 161*b* and 162*b* are may be arranged between the first imaging lens 140*ab* and the second imaging lens 150*b* on the optical path of the second light beam L2. The first and second reflection members 161*b* and 162*b* each may have a lengthy rectangular reflection surface to cover the entire width of a scanning line of the second light beam L2 that is scanned and deflected by the light deflector 130. First and second assembly members 171 and 172 for respectively fixing the first and second reflection members 161*b* and 162*b* on the housing 190 may be provided at the opposite ends of each of the first and second reflection members 161*b* and 162*b*. The first and second assembly members 171 and 172 according to an exemplary embodiment use first and second elastic springs 1711 and 1721 formed of a steel material having elasticity as pressing members. The first assembly member 171 that fixes the first reflection member 161*b* relatively closer to the light deflector 130 on the housing 190 and the second assembly member 172 that fixes the second reflection member 162*b* relatively further away from the light deflector 130 on the housing 190, in view of the sub-scanning section, may be arranged such that a pressing force by the first and second elastic springs 1711 and 1721 can be applied in the same direction and thus the first and second reflection members 161*b* and 162*b* may collapse to incline in a same direction.

The third and fourth reflection members 161*c* and 162*c* each may have a lengthy rectangular reflection surface to cover the entire width of a scanning line of the second light beam L2 that is scanned and deflected by the light deflector 130. Third and fourth assembly members 173 and 174 for respectively fixing the third and fourth reflection members 161*c* and 162*c* on the housing 190 may be provided at the opposite ends of each of the third and fourth reflection members 161*c* and 162*c*. The third assembly member 173 that fixes the third reflection member 161*c* on the housing 190 and the fourth assembly member 174 that fixes the fourth reflection member 162*c* on the housing 190, in view of the sub-scanning section, may be arranged such that a pressing force by the elastic springs 1731 and 1741 can be applied in the same direction. Thus, the third and fourth reflection members 161*c* and 162*c* may collapse to incline in the same direction.

The first and second assembly members 171 and 172 are described with reference to FIGS. 4 to 8.

Figure 4:
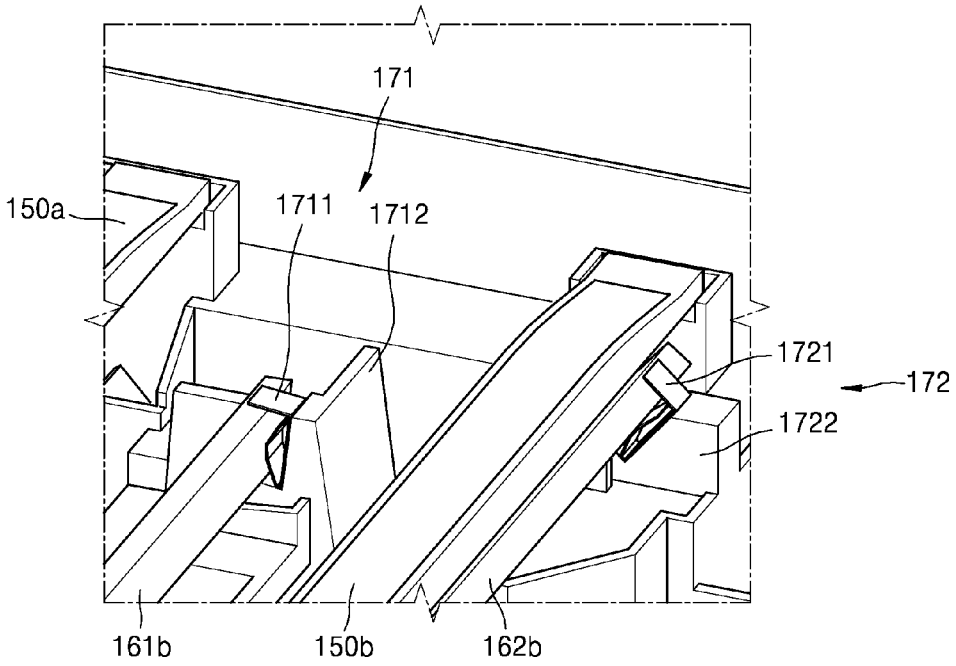
FIG. 4 illustrates an exemplary area where first and second assembly members are provided in a light scanning unit.
Figure 5:
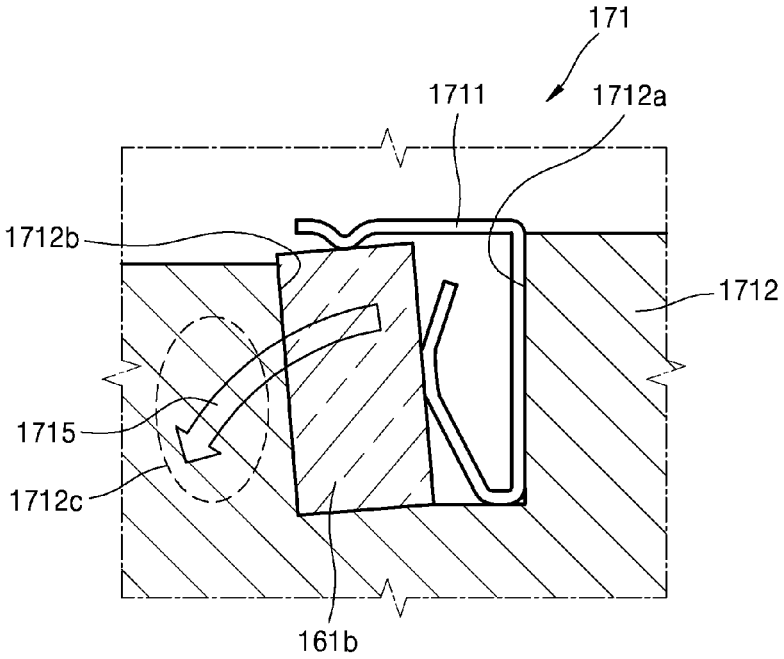
FIG. 5 is a cross-sectional view schematically illustrating an exemplary first assembly member in a light scanning unit.

FIG. 4 illustrates an exemplary area of the first and second assembly members 171 and 172 that are respectively provided at one of the end portions of the first and second reflection members 161*b* and 162*b* in the light scanning unit 100 of FIG. 1. FIG. 5 is a cross-sectional view schematically illustrating the first assembly member 171 and one end of the first reflection member 161*b* coupled by the first assembly member 171, in view of the sub-scanning section.

Referring to FIGS. 4 and 5, the first assembly member 171 includes a first placement portion 1712 in which a first groove portion 1712*a*, into which one end of the first reflection member 161*b* is inserted, may be formed. The first elastic spring 1711 may be inserted in a gap between a portion where the first reflection member 161*b* is inserted and the first groove portion 1712*a*. The first elastic spring 1711 fixes the first reflection member 161*b* by elastically pressing one end of the first reflection member 161*b*. The second assembly member 172 includes a second placement portion 1722 where a second groove portion 1722*a*, into which one end of the second reflection member 162*b* is inserted, is formed and the second elastic spring 1721 inserted in a gap between a portion where the second reflection member 162*b* is inserted and the second groove portion 1722*a*. The first and second placement portions 1712 and 1722 may be integrally formed by extending from the housing 190 or separately provided to be attached to the housing 190.

Referring to FIG. 5, as the first elastic spring 1711 elastically presses the first reflection member 161*b*, a pressing force may be applied to a placement surface 1712*b* of the first placement portion 1712 contacting the first reflection member 161*b*. The pressing force applied to the placement surface 1712*b* of the first placement portion 1712 may be not only generated when the first reflection member 161*b* is assembled in the first assembly member 171 but also continuously generated by a continuous elastic force of the first elastic spring 1711. The continuous pressing force may cause deformation in an adjacent area 1712*c* of the placement surface 1712*b* of the first placement portion 1712. A first placement portion 1712 may be deformed by an increase of an internal temperature generated during a print operation of the light scanning unit 100 or an image forming apparatus including the light scanning unit 100. As a result, the placement surface 1712*b* of the first placement portion 1712 may be deformed in a direction 1715 and thus the first reflection member 161*b* inclines in the direction 1715.

Figure 6:
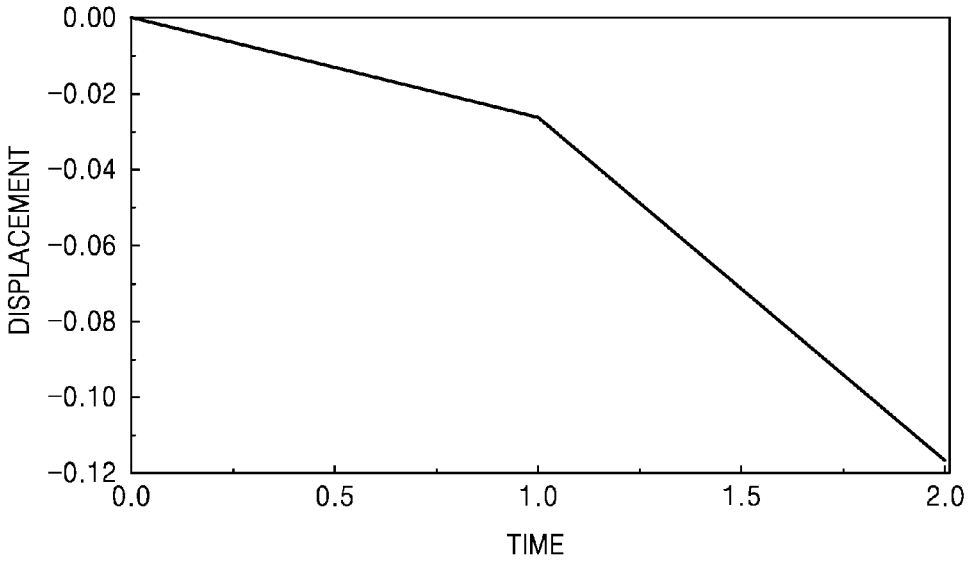
FIG. 6 is a graph illustrating an exemplary inclination of a reflection member according to an increase in a coupling pressure surface and a temperature.

FIG. 6 illustrates an inclination of a reflection member according to an increase in a coupling pressure surface and a temperature. In FIG. 6, time and displacement are illustrated as arbitrary units. A section between 0.0 to 1.0 on the time axis denotes a period during which a reflection member is coupled to the housing 190 of the light scanning unit. Room temperature is maintained during the section between 0.0 to 1.0 on the time axis. A section between 1.0 to 2.0 on the time axis denotes a period during which the light scanning unit is operated after the reflection member is coupled to the housing 190 of the light scanning unit. During the section between 1.0 to 2.0 on the time axis, the temperature in the light scanning unit increases to 40° C. according to an operation. As illustrated in FIG. 6, the reflection member inclines when it is coupled to the housing 190 of the light scanning unit, and the amount of inclination gradually increases during the operation of the light scanning unit after the coupling of the reflection member to the housing 190 of the light scanning unit by the influence of a temperature increase.

Figure 7:
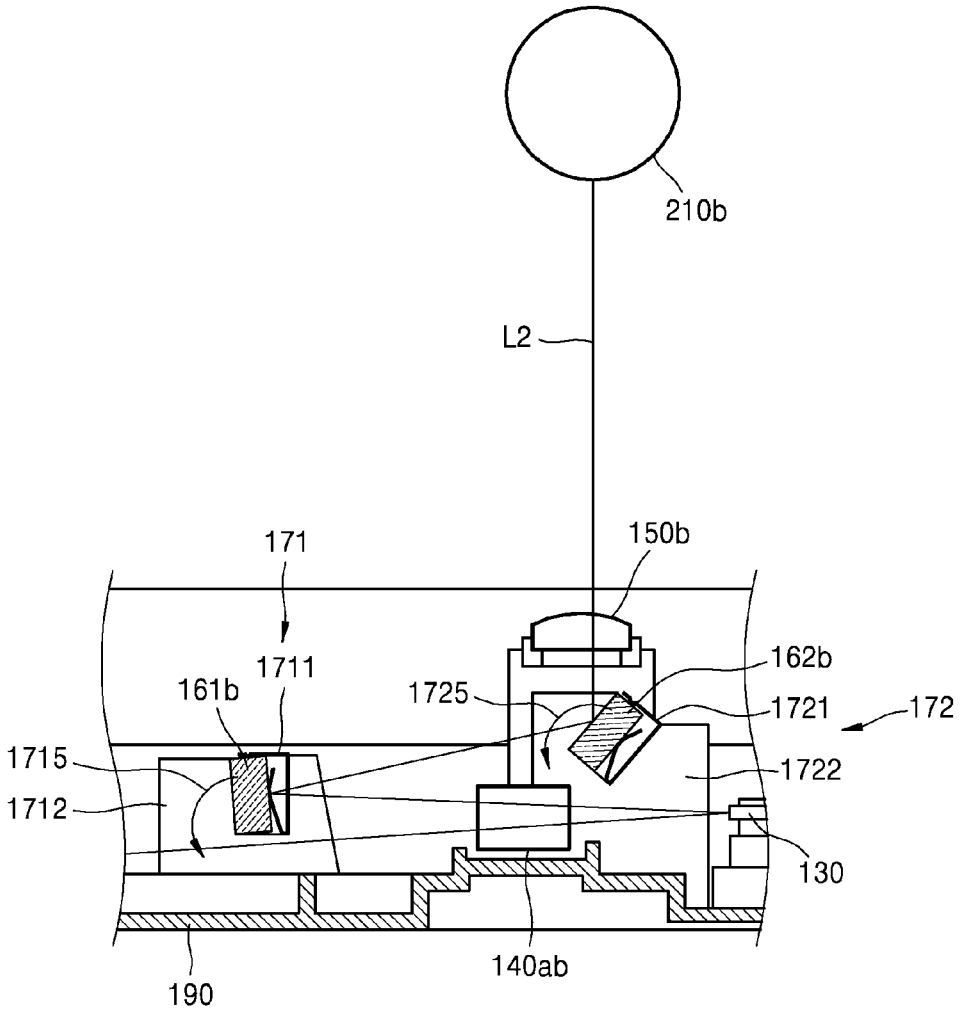
FIG. 7 illustrates an exemplary inclination of first and second reflection members in a light scanning unit.
Figure 8:
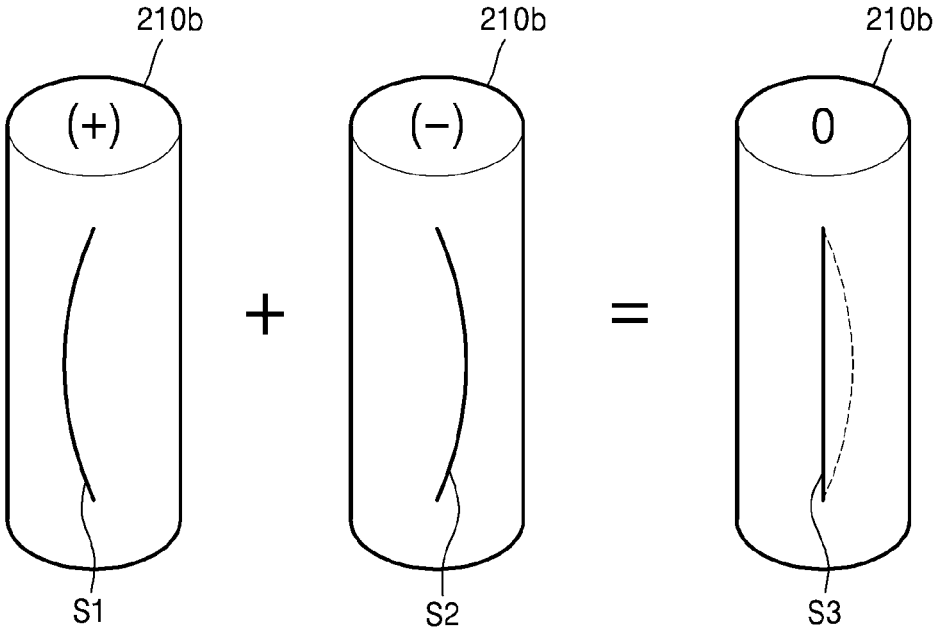
FIG. 8 illustrates an exemplary offset of the curvature of a scanning line according to the inclination of first and second reflection members in a light scanning unit.

FIG. 7 illustrates the inclination of the first and second reflection members 161*b* and 162*b* placed on the optical path of the second light beam L2 in the light scanning unit 100 of FIG. 1. FIG. 8 illustrates an offset of the curvature of a scanning line of the second light beam L2 according to the inclination of first and second reflection members 161*b* and 162*b*.

Referring to FIG. 7, the first reflection member 161*b* and the second reflection member 162*b* may be arranged such that reflection surfaces thereof face each other. The second light beam L2 that is scanned and deflected by the light deflector 130 and passes through the first imaging lens 140*ab* may be reflected by the first reflection member 161*b* and reflected again by the second reflection member 162*b* to proceed toward the second photosensitive drum 210*b*. The first assembly member 171 that couples the first reflection member 161*b* to the housing 190 and the second assembly member 172 that couples the second reflection member 162*b* to the housing 190 may be arranged such that pressing forces are applied in the same direction in view of the sub-scanning section. A pressing force of the first elastic spring 1711 may be applied in a direction toward the reflection surface of the first reflection member 161*b* whereas a pressing force of the second elastic spring 1721 may be applied in a direction toward a rear surface of the reflection surface of the second reflection member 162*b*. As illustrated in FIGS. 4 to 6, the first and second reflection members 161*b* and 162*b* are collapsed by the continuous pressing forces of the first and second assembly members 171 and 172. Thus, by making the directions of the pressing forces of the first and second assembly members 171 and 172 identical, the direction 1715 in which the first reflection member 161*b* inclines and a direction 1725 in which the second reflection member 162*b* inclines are identical to each other in view of the sub-scanning section.

The inclination of the first and second reflection members 161*b* and 162*b* affect a passing position of the second light beam L2 in the sub-scanning section, thereby causing main scanning curvature. However, as the direction 1715 in which the first reflection member 161*b* inclines and the direction 1725 in which the second reflection member 162*b* inclines are identical to each other, the opposing reflection surfaces of the first and second reflection members 161*b* and 162*b* incline in the same direction. Thus, a main scanning curvature S1 of FIG. 8 due to the inclination of the first reflection member 161*b* and a main scanning curvature S2 of FIG. 8 due to the inclination of the second reflection member 162*b* are formed opposite to each other. As a result, the main scanning curvature S1 due to the inclination of the first reflection member 161*b* and the main scanning curvature S2 due to the inclination of the second reflection member 162*b* are offset so that a main scanning curvature S3 of a scanning line formed by the second light beam L2 scanned onto the second photosensitive drum 210*b* may be removed.

Figure 9:
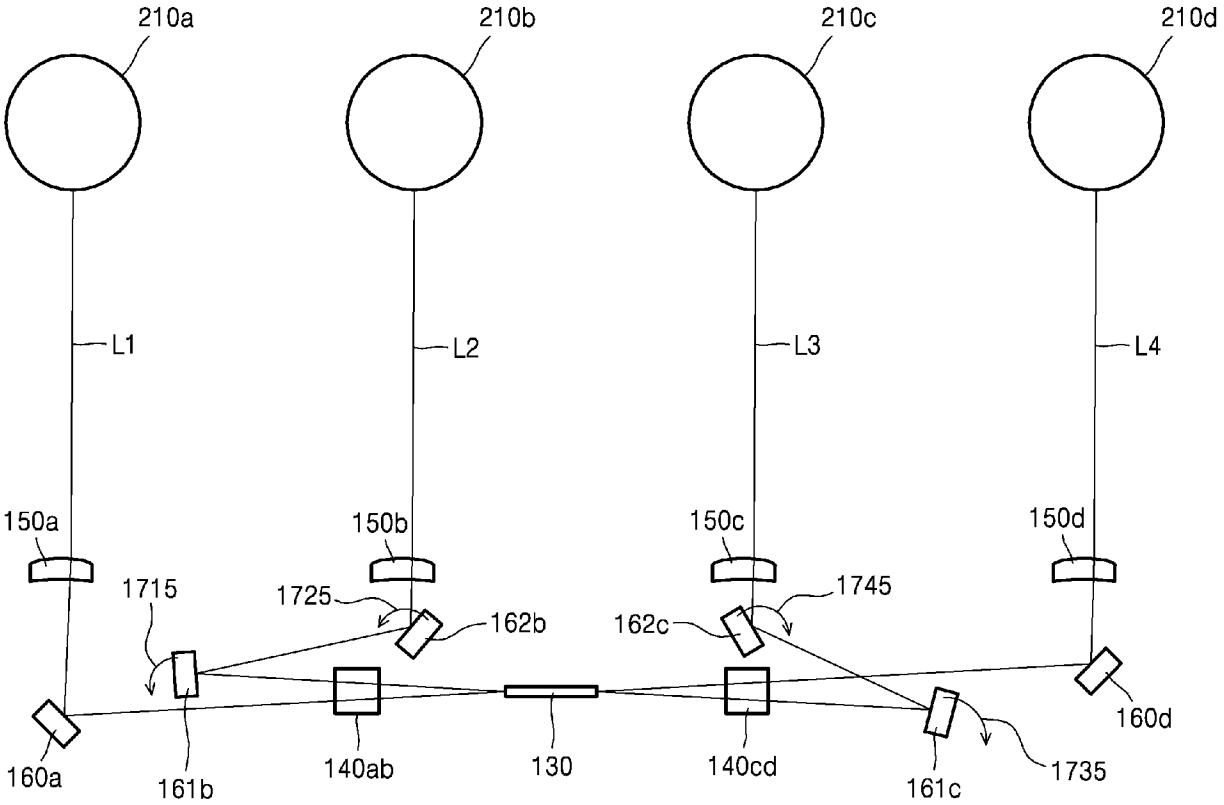
FIG. 9 illustrates exemplary directions in which reflection members incline in a light scanning unit.
Figure 10A:
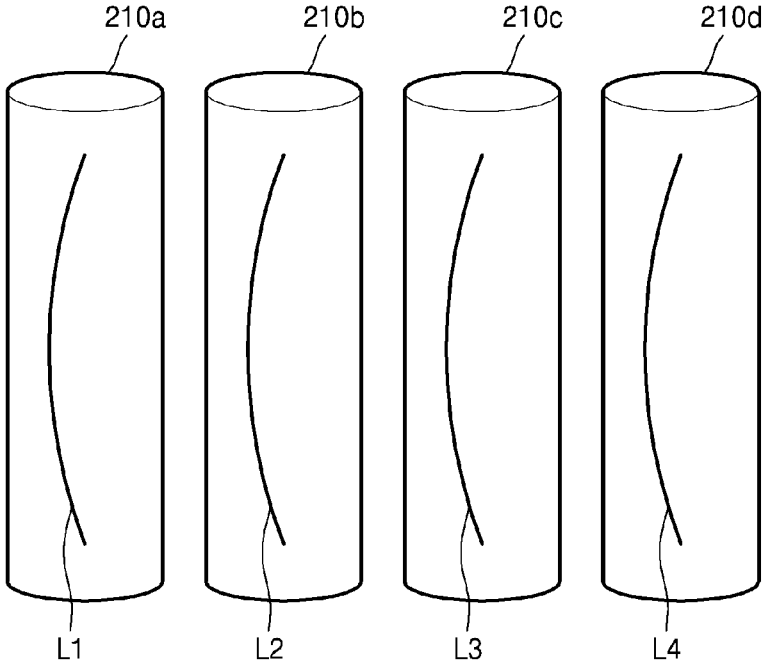
FIGS. 10A and 10B illustrate an exemplary curvature of a scanning line according to the inclination of reflection members in a light scanning unit.
Figure 10B:
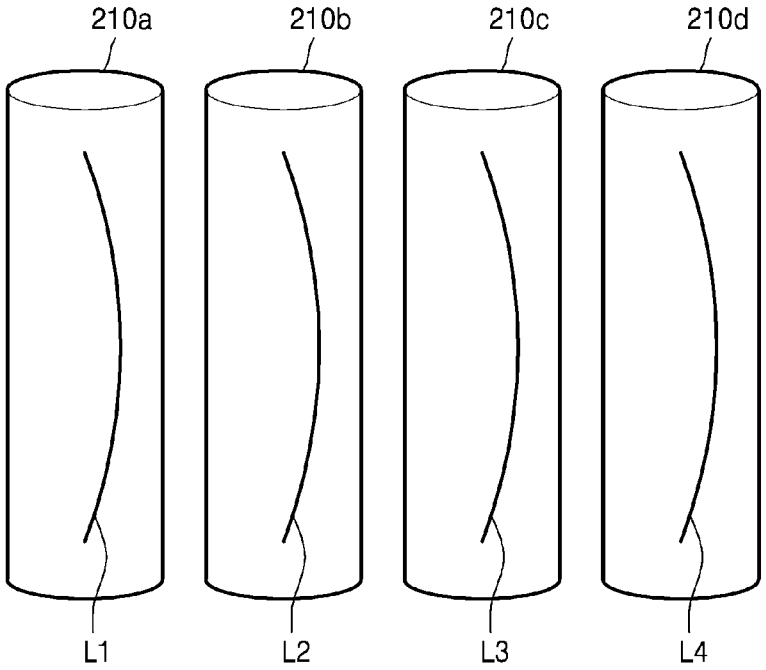

FIG. 9 illustrates directions of the inclination of all the first to fourth reflection members 161*b*, 162*b*, 161*c*, and 162*c* in the light scanning unit 100 of FIG. 1. FIGS. 10A and 10B illustrate an exemplary curvature of a scanning line according to the inclination of all the first to fourth reflection members 161*b*, 162*b*, 161*c*, and 162*c* in the light scanning unit 100 of FIG. 9.

According to an exemplary embodiment, a main scanning curvature of the second light beam L2 of FIG. 10A due to the inclination of the first reflection member 161*b* and a main scanning curvature of the second light beam L2 of FIG. 10B due to the inclination of the second reflection member 162*b* are offset by making the direction 1715 in which the first reflection member 161*b* inclines and the direction 1725 in which the second reflection member 162*b* inclines identical in view of the sub-scanning section. A main scanning curvature of the third light beam L3 of FIG. 10A due to the inclination of the third reflection member 161*c* and a main scanning curvature of the third light beam L3 of FIG. 10B due to the inclination of the fourth reflection member 162*c* are offset by making a direction 1735 in which the third reflection member 161*c* inclines and a direction 1745 in which the fourth reflection member 162*c* inclines identical in view of the sub-scanning section.

Color registration denotes matching toner images having different colors when a color image is formed by overlapping toner images of different colors with each other. In a light scanning process, scanning lines forming an electrostatic latent image that is a base toner image match each other with respect to different colors. To implement a superior characteristic of the color registration, is desired that scanning lines of all colors have a same main scanning curvature characteristic. In the light scanning unit 100 of an exemplary embodiment, by offsetting curvatures of scanning lines generated by the respective reflection members with respect to a light beam passing through the two reflection members as illustrated in FIGS. 10A and 10B, the quality of a color image formed by overlapping toner images corresponding to the scanning lines may be improved.

Figure 11:
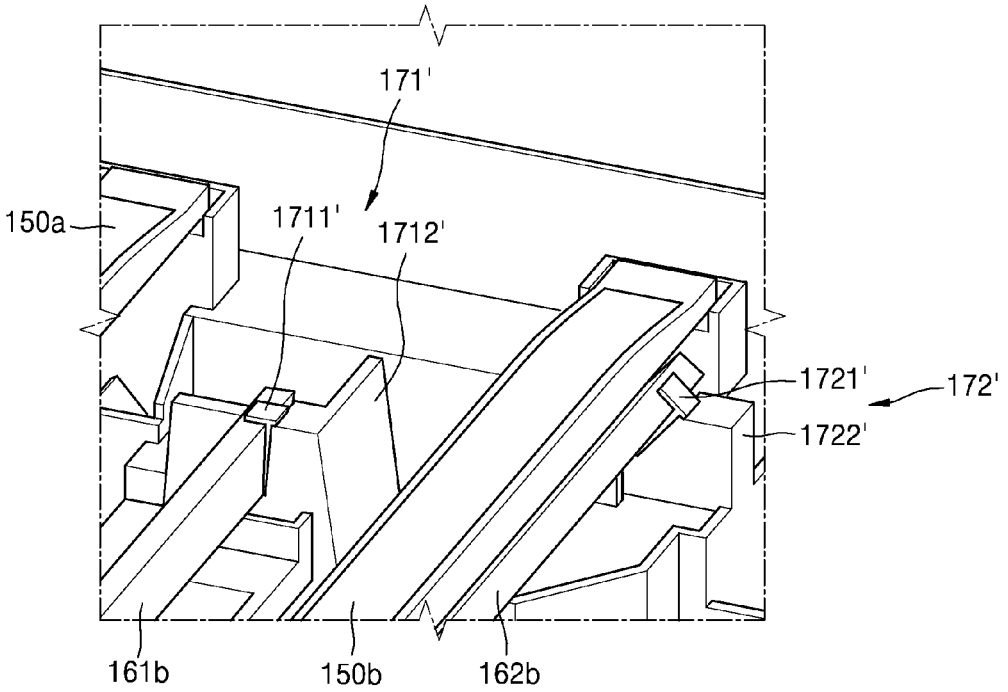
FIG. 11 illustrates exemplary first and second assembly members in a light scanning unit according to an embodiment of the present invention.
Figure 12:
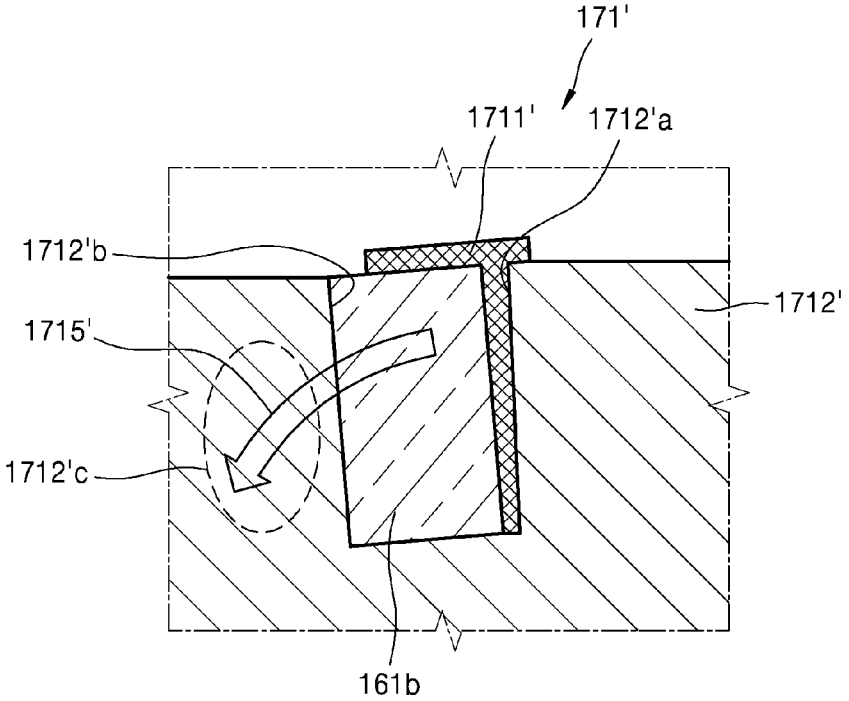
FIG. 12 is a cross-sectional view schematically illustrating a first assembly member in a light scanning unit.
Figure 13:
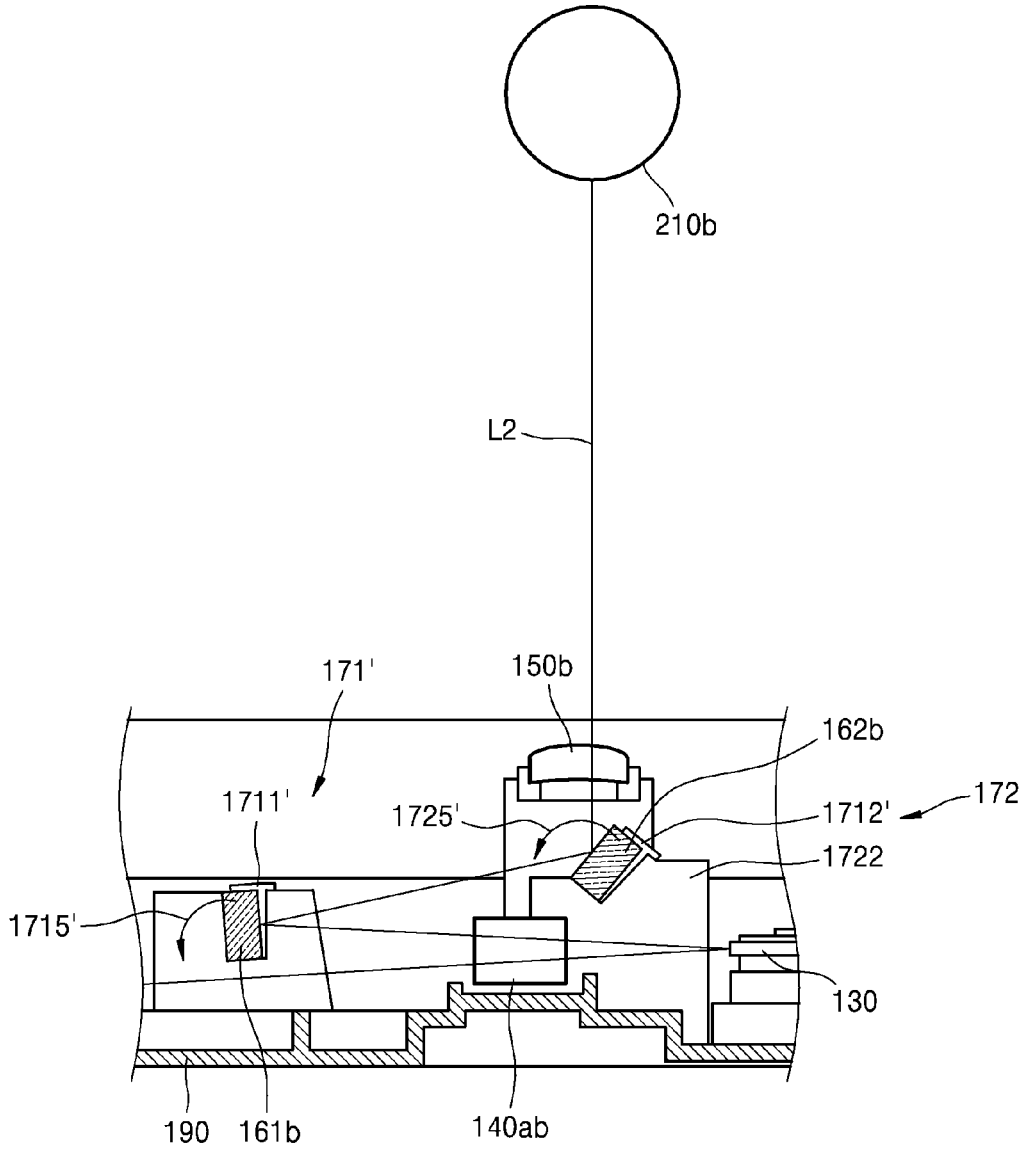
FIG. 13 illustrates an exemplary inclination of first and second reflection members in a light scanning unit.

FIG. 11 illustrates exemplary first and second assembly members 171' and 172' in a light scanning unit according to an embodiment of the present invention. FIG. 12 illustrates an exemplary first assembly member 171' in the light scanning unit of FIG. 11. FIG. 13 illustrates an inclination of the first and second reflection members 161*b* and 162*b* in the light scanning unit of FIG. 11. In the light scanning unit according to an exemplary embodiment, since elements except for an assembly member for fixing a reflection member may be substantially the same as those of the light scanning unit 100 described with reference to FIGS. 1 to 10, only the assembly members are further described.

Referring to FIG. 11, the first assembly member 171' according to an exemplary embodiment includes a first placement portion 1712' located at opposite ends of the first reflection member 161*b* and a wedge 1711' fixing the first reflection member 161*b* by pressing the first reflection member 161*b* in the first placement portion 1712'. The second assembly member 172' according to an exemplary embodiment includes a second placement portion 1722' located at opposite ends of the second reflection member 162*b* and a wedge 1721' fixing the second reflection member 162*b* by pressing the second reflection member 162*b* in the second placement portion 1722'. The wedges 1711' and 1721' are examples of a pressing member for pressing and fixing the first and second reflection members 161*b* and 162*b*.

As illustrated in FIG. 12, when the first reflection member 161*b* is fixed by forcibly inserting the wedge 1711' in the first placement portion 1712', the wedge 1711' presses the first reflection member 161*b* and thus a pressing force acts on a placement surface 1712'*b* of the first placement portion 1712' in a pressing direction. As a result, an area 1712'*c* that receives a pressing force of the first placement portion 1712' may be deformed and thus the first reflection member 161*b* collapses to incline in a direction 1715'. The inclination of the first reflection member 161*b* may be substantially the same as the inclination of the first reflection member 161*b* by the first assembly member 171 using the first and second elastic springs 1711 and 1721. Thus, as illustrated in FIG. 13, by making the direction in which the first assembly member 171' presses the first reflection member 161*b* and the direction in which the second assembly member 172' presses the second reflection member 162*b* identical to each other, a scanning line curvature due to the inclination of the first reflection member 161*b* and a scanning line curvature due to the inclination of the second reflection member 162*b* are offset.

FIG. 14 illustrates an exemplary electrophotographic image forming apparatus including a light scanning unit 100, according to an embodiment of the present invention. The electrophotographic image forming apparatus of FIG. 14 is a dry electrophotographic image forming apparatus that prints a color image by using a dry developer (hereinafter, referred to as toner).

The electrophotographic image forming apparatus according to an exemplary embodiment includes the light scanning unit 100, developing units 200, an intermediate transfer belt 300, first and second transfer rollers 310 and 320, and a fusing unit 400, which may be accommodated in a cabinet 600.

The light scanning unit 100 scans a plurality of light beams and may be the light scanning units described with reference to FIGS. 1 to 11. For example, the light scanning unit 100 may scan four light beams corresponding to black K, magenta M, yellow Y, and cyan C colors.

The developing units 200 may be provided according to colors corresponding to the light beams. For example, the developing units 200 may be provided for black K, magenta M, yellow Y, and cyan C color. The developing units 200 may be separately arranged in the sub-scanning direction at a predetermined interval to each other. Each of the developing units 200 may be provided with a photosensitive drum 210 that is an image receptor on which an electrostatic latent image is formed for each color and a developing roller 220 for developing the electrostatic latent image.

The photosensitive drum 210 is an example of an image holding body, and a photosensitive layer having a predetermined thickness is formed on an outer circumferential surface of a cylindrical metal pipe. The outer circumferential surface of the photosensitive drum 210 may become a to-be-scanned surface. The photosensitive drum 210 may be partially exposed to the outside of the developing unit 200. A photosensitive belt in a belt form may be employed as the image holding body instead of the photosensitive drum 210.

A charging roller 230 may be provided at the upstream side with respect to a position where the outer circumferential surface of the photosensitive drum 210 is exposed by the light scanning unit 100. The charging roller 230 is an example of a charger that charges a surface of the photosensitive drum 210 to a uniform electric potential while rotating in contact with the photosensitive drum 210. A charge bias may be applied to the charging roller 230. A corona charger (not shown) may be used instead of the charging roller 230. Toner may be attached to an outer circumferential surface of the developing roller 220 and then is supplied to the photosensitive drum 210. A development bias to supply the toner to the photosensitive drum 210 is applied to the developing roller 220. Although it is not illustrated, each of the developing units 200 may further include a supply roller for attaching the toner contained therein on the developing roller 220, a restriction unit for restricting the amount of toner attached on the developing roller 220, and an agitator (not shown) for transferring the toner contained in each of the developing units 200 toward the supply roller and/or the developing roller 220.

The intermediate transfer belt 300 may face the outer circumferential surface of the photosensitive drum 210 that is exposed to the outside of the developing units 200. The intermediate transfer belt 300 is an example of an intermediate transfer body for transferring a toner image of the photosensitive drum 210 to a sheet of paper P. An intermediate transfer drum may be used as the intermediate transfer body instead of the intermediate transfer belt 300. The intermediate transfer belt 300 circulates in contact with the photosensitive drum 210. The first transfer roller 310 may be arranged at four positions facing the photosensitive drum 210 with the intermediate transfer belt 300 interposed between the first transfer roller 310 and the photosensitive drum 210. As a first transfer bias is applied to the first transfer roller 310, the toner image of the photosensitive drum 210 is transferred to the intermediate transfer belt 300.

The second transfer roller 320 may be arranged to face the intermediate transfer belt 300 so that the paper P may pass therebetween. A second transfer bias may be applied to the second transfer roller 320 so that the toner image of the intermediate transfer belt 300 may be transferred to the paper P.

A process of forming a color image in the electrophotographic image forming apparatus configured is disclosed.

The photosensitive drum 210 of each of the developing units 200 may be charged to a uniform electric potential by a charging bias applied to the charging roller 230.

The light scanning unit 100 exposes the to-be-scanned surface of the photosensitive drum 210 in a lengthwise direction, that is, the main scanning direction. The to-be-scanned surface may be moved in the sub-scanning direction according to the rotation of the photosensitive drum 210 and thus a two-dimensional electrostatic latent image corresponding to image information about each black K, magenta M, yellow Y, and cyan C color is formed on the to-be-scanned surface of each photosensitive drum 210. The sub-scanning direction may be perpendicular to the main scanning direction. Each of the developing units 200 supplies toner of one of the black K, magenta M, yellow Y, and cyan C colors to the photosensitive drum 210 to form a toner image of each black K, magenta M, yellow Y, and cyan C color.

The toner images of the black K, magenta M, yellow Y, and cyan C colors, each being formed on each photosensitive drum 210, are transferred to the intermediate transfer belt 300 to overlap with each other by the first transfer bias applied to the first transfer roller 310, thereby forming a color toner image.

A medium for finally holding the toner, for example, the paper P, may be transferred by a pickup roller 610 and a transfer roller 620 and inserted between the intermediate transfer belt 300 and the second transfer roller 320. The color toner image transferred to the intermediate transfer belt 300 is transferred to the paper P by the second transfer bias applied to the second transfer roller 320. The color toner image transferred to the paper P may be maintained on a surface of the paper P by an electrostatic force. The paper P to which the color toner image is transferred is transferred to the fusing unit 400. The color toner image transferred to the paper P is fused on the paper P by receiving heat and pressure at a fusing nip of the fusing unit 400. The paper P that is completely fused is carried out of the electrophotographic image forming apparatus by an eject roller 630.

Although forming a color image is described in the electrophotographic image forming apparatus of an exemplary embodiment, the present invention is not limited thereto. For example, when a black and white image is to be formed, the light scanning unit 100 may scan only one light beam and one of the developing units 200 may be provided only for one light beam. According to an exemplary embodiment of an electrophotographic image forming apparatus, elements other than the light scanning unit 100, for example, the developing units 200, the intermediate transfer belt 300, the first and second transfer rollers 310 and 320, and the fusing unit 400, described as examples of a printing unit for transferring a toner image to a print medium in an electrophotographic method may be included. Various printing units may be applied to the electrophotographic image forming apparatus according to an exemplary embodiment of the present invention.

In a light scanning unit according to an exemplary embodiment of the present invention and the electrophotographic image forming apparatus including the same, since the assembly structure may be configured to be changed in a direction in which scanning line curvature characteristics of reflection members used in the light scanning unit are offset with each other, the assembly structure of the reflection members may be simply configured without using a separate adjustment member and thus the number of parts and material costs may be reduced. In the light scanning unit according to an exemplary embodiment of present invention and the electrophotographic image forming apparatus including the same, a change in the scanning line curvature characteristic according to the shape allowance and assembly deviation of the reflection member assembly member or the elastic spring may be reduced and thus mass productivity may be obtained and a change of the characteristic according to a change in temperature may be reduced. When the light scanning unit according to the present invention is applied to a color electrophotographic image forming apparatus, a high quality color registration characteristic may be obtained.

While the above-described light scanning unit according to the present invention and the electrophotographic image forming apparatus including the same have been particularly shown and described with reference to exemplary embodiments thereof, it will be understood by those skilled in the art that various changes in form and details may be made therein without departing from the spirit and scope of the invention as defined by the appended claims.

What is claimed is:

1. A light scanning unit comprising:

a light source unit to emit a light beam according to an image signal;

a light deflector to scan and deflect the light beam emitted from the light source unit;

an imaging optical system that comprises at least one imaging lens arranged on an optical path from the light deflector to a to-be-scanned surface and imaging the light beam scanned and deflected by the light deflector on the to-be-scanned surface, and first and second reflection members arranged on the optical path from the light deflector to the to-be-scanned surface;

a housing to accommodate the light source unit, the light deflector, and the imaging optical system; and first and second assembly members to press and fix the first and second reflection members on the housing, wherein the first and second assembly members respectively press and fix the first and second reflection members on the housing by respectively pressing the first and second reflection members in respective directions in which a curvature of a scanning line due to the inclination of the first reflection member offsets a curvature of a scanning line due to the inclination of the second reflection member.

2. The light scanning unit of claim 1, wherein a reflection surface of the first reflection member and a reflection surface of the second reflection member are arranged to face each other and, in view of a sub-scanning section, pressing directions of the first and second assembly members are determined such that a direction in which the first reflection member is inclined by the first assembly member and a direction in which the second reflection member is inclined by the second assembly member are substantially the same direction.

3. The light scanning unit of claim 1, wherein the first assembly member comprises a first placement portion having a first groove portion into which a part of the first reflection member is inserted and a first pressing member inserted in a gap between the first reflection member and the first groove portion and pressing and fixing the first reflection member, and the second assembly member comprises a second placement portion having a second groove portion into which a part of the second reflection member is inserted and a second pressing member inserted in a gap between the second reflection member and the second groove portion and pressing and fixing the second reflection member.

4. The light scanning unit of claim 3, wherein a reflection surface of the first reflection member and a reflection surface of the second reflection member are arranged to face each other, and a pressing direction of the first assembly member is toward the reflection surface of the first reflection member and a pressing direction of the second assembly member is toward a rear surface of the reflection surface of the second reflection member.

5. The light scanning unit of claim 3, wherein a direction in which a first placement surface of the first placement portion, where the first reflection member is placed, is deformed due to the first assembly member and a direction in which a second placement surface of the second placement portion, where the second reflection member is placed, is deformed due to the second assembly member are substantially the same direction in view of a sub-scanning section.

6. The light scanning unit of claim 3, wherein the first and second pressing members are elastic springs that elastically press the first and second reflection members.

7. The light scanning unit of claim 3, wherein the first and second pressing members are wedges that are forcibly inserted into the first and second groove portions to press the first and second reflection members.

8. The light scanning unit of claim 1, wherein the first reflection member is arranged on an optical path between the at least one imaging lens and the second reflection member, and the second reflection member is arranged on an optical path between the at least one imaging lens and the to-be-scanned surface.

9. The light scanning unit of claim 1, wherein the imaging optical system comprises a plurality of imaging lenses arranged on the optical path from the light deflector to the to-be-scanned surface, the first reflection member is arranged on an optical path between the second reflection member and an imaging lens located closest to the light deflector, and the second reflection member is arranged between the plurality of imaging lenses.

10. The light scanning unit of claim 9, wherein the imaging lens located closest to the light deflector among the plurality of imaging lenses is eccentrically arranged such that a light beam passes through the imaging lens located closest to the light deflector to be deflected in a sub-scanning direction with respect to an apex of an imaging lens located closest to the to-be-scanned surface.

11. The light scanning unit of claim 9, wherein a refractive power of an imaging lens located closest to the to-be-scanned surface in a sub-scanning direction among the plurality of imaging lenses is substantially zero.

12. The light scanning unit of claim 1, wherein the light source unit comprises a plurality of light sources for emitting a plurality of light beams and the first and second reflection members are provided on an optical path of at least one of the plurality of light beams.

13. The light scanning unit of claim 12, wherein at least two light beams of the plurality of light beams emitted from the light sources are scanned by being deflected by the same deflection surface of the light deflector.

14. The light scanning unit of claim 13, wherein the at least two light beams are obliquely incident on the deflection surface of the light deflector at different incident angles.

15. The light scanning unit of claim 14, wherein the incident angle of the at least two light beams in the sub-scanning section on the deflection surface of the light defector is within a range between about 2 degrees to about 4 degrees.

16. The light scanning unit of claim 12, wherein the imaging optical system comprises one first imaging lens that is located closest to the light deflector and commonly used for the at least two light beams and a plurality of second imaging lenses individually provided with respect to the at least two light beams.

17. The light scanning unit of claim 16, wherein the first reflection member is arranged on an optical path between the first imaging lens and the second imaging lens and the second reflection member is arranged on an optical path between the first reflection member and the second imaging lens.

18. The light scanning unit of claim 1, wherein the light source unit comprises first to fourth light sources for emitting first to fourth light beams, the light deflector scans and deflects the first and second light beams of the first to fourth light beams emitted from the first to fourth light sources on a deflection surface of the light deflector and scans and deflects the third and fourth light beams on another deflection surface that is diagonally located with respect to the light deflector, and the imaging optical system comprises one reflection member arranged on an optical path of the first light beam, third and fourth reflection members arranged on an optical path of the third light beam, and another reflection member arranged on an optical path of the fourth light beam, and the first and second reflection members are arranged on an optical path of the second light beam.

19. The light scanning unit of claim 18, further comprising third and fourth assembly members for respectively pressing and fixing the third and fourth reflection members on the housing, wherein, in view of the sub-scanning section, pressing directions of the first to fourth assembly members are determined as a direction, in which the first and second reflection members are inclined by the first and second assembly members, and a direction, in which of the third and fourth reflection members are inclined by the third and fourth assembly members, that are substantially opposite to each other.

20. An electrophotographic image forming apparatus comprising:

an image holding body;

a light scanning unit to form an electrostatic latent image by scanning a light beam onto a to-be-scanned surface of the image holding body; and a developing unit to develop the electrostatic latent image formed on the image holding body by supplying toner to the electrostatic latent image, wherein the light scanning unit comprises:

a light source unit to emit a light beam according to an image signal;

a light deflector to scan and deflect the light beam emitted from the light source unit;

an imaging optical system that comprises at least one imaging lens arranged on an optical path from the light deflector to the to-be-scanned surface and imaging the light beam scanned and deflected by the light deflector on the to-be-scanned surface, and first and second reflection members arranged on the optical path from the light deflector to the to-be-scanned surface;

a housing to accommodate the light source unit, the light deflector, and the imaging optical system; and first and second assembly members to press and fix the first and second reflection members on the housing, wherein the first and second assembly members respectively press and fix the first and second reflection members on the housing by respectively pressing the first and second reflection members in respective directions in which curvature of a scanning line due to the inclination of the first reflection member offsets a curvature of a scanning line due to the inclination of the second reflection member.

21. A light scanning unit comprising:

a light deflector to scan and deflect a light beam emitted from a light source unit;

an imaging optical system imaging the light beam scanned and deflected by the light deflector on a to-be-scanned surface and including first and second reflection members arranged on an optical path from the light deflector to the to-be-scanned surface; and first and second assembly members to respectively press the first and second reflection members on a housing accommodating the light source unit, the light deflector, and the imaging optical system in respective directions in which a curvature of a scanning line due to an inclination of the first reflection member offsets a curvature of a scanning line due to an inclination of the second reflection member.

* * * * *